United States Patent [19]

Carpenter

[11] Patent Number: 4,718,664

[45] Date of Patent: Jan. 12, 1988

[54] PORTABLE, LIGHT WEIGHT EXERCISE MACHINE

[75] Inventor: David P. Carpenter, Fort Washington, Md.

[73] Assignee: M. Michael Carpenter, Tarzana, Calif.

[21] Appl. No.: 746,630

[22] Filed: Jun. 19, 1985

[51] Int. Cl.[4] ..... A63B 21/00

[52] U.S. Cl. ..... 272/130; 272/134; 272/116

[58] Field of Search ..... 272/116, 123, 130, 131, 272/132, 134, 135, 136, 143

[56] References Cited

U.S. PATENT DOCUMENTS

| | | | |
|---|---|---|---|
| D. 263,978 | 4/1982 | Brentham . | |
| 2,825,563 | 3/1958 | Lawton . | |
| 3,127,171 | 3/1964 | Noland et al. | 272/134 |
| 3,387,436 | 6/1968 | Chandler . | |
| 3,495,824 | 2/1970 | Cuinier | 272/134 |
| 3,768,808 | 10/1973 | Passara | 272/132 |
| 4,183,520 | 1/1980 | Chase . | |
| 4,227,689 | 10/1980 | Keiser . | |
| 4,254,949 | 3/1981 | Brentham . | |
| 4,441,708 | 4/1984 | Brentham . | |
| 4,448,412 | 5/1984 | Brentham . | |
| 4,466,613 | 8/1984 | Reese | 272/136 |
| 4,566,691 | 1/1986 | Mahnke | 272/123 |

OTHER PUBLICATIONS

B. Burrough, Allure of Home-*Exercise Devices Sparks Big Sales-and Many Injuries, Wall Street Journal,* 8/18/85, p. 33.

*Athletic Journal,* Nov. 1982, Inside Front Cover Popular Science, Month unknown, 1985, p. 52.

Entrepreneur, Jun. 1985, p. 15.

*Primary Examiner*—Richard J. Apley

*Assistant Examiner*—J. Welsh

*Attorney, Agent, or Firm*—Poms, Smith, Lande & Rose

[57] ABSTRACT

A portable, light weight exercise machine is shown that includes a housing for carriage and storage of various parts which make up the machine. To use the machine, it is placed upon a table and the parts removed from the housing. A resistance device which forms a the major component of the machine is placed into its operating position by rotating a pivot head 180 degrees without the need to assemble or disassemble any parts. Once the resistance device is placed into its operating position, a lever is attached to the pivot head which the user may hold or attach to his or her ankles to exercise his or her upper or lower body while sitting upon the housing to retain it upon the table.

17 Claims, 21 Drawing Figures

10
12
14
16
18
20
22
24
26
28
32
36
38
44
68
70
72
74
82
84
86
128
144
148
150
154
156
158
160
162

PORTABLE, LIGHT WEIGHT EXERCISE MACHINE

BACKGROUND OF THE INVENTION

1. Field Of The Invention

The present invention relates to a portable, light weight exercise machine and, more particularly, to an exercise machine which may be utilized in office of home to exercise the lower body, such as the thigh muscles by leg extension or leg curl movements, and the upper body, such as the back and arm muscles by arm curl or rowing movements.

2. Summary Of The Prior Art

Exercise devices of all types are well known. According to a recent article in the *Wall Street Journal* of Apr. 18, 1985, at Page 33, section 2, fitness enthusiasts paid an estimated $1.2 billion in 1984 for home-exercise equipment. It is stated in the same article that more than 90 models of rowing machines were shown at a recent National Sporting Goods Convention in Dallas, Texas. The year before only three models were shown. The article goes on to make the point that if a person wants fitness, that person does not need equipment. Rather, the fitness buff can run, swim or do jumping jacks. The other side of that statement is that many exercise enthusiasts or amateur runners develop injuries which may prevent them from running or swimming while recovering from their injury. Further, amateur or professional atheletes often have a tendency to overdevelop the quadricep or the front thigh area of the leg over the leg biseps or back thigh area. For these individuals, specialized exercise equipment is often desirable.

Exercise equipment of one form or another is well known. Examples of prior art equipment may be found in the following U.S. Pat. No. 2,825,563, issued Mar. 4, 1958; U.S. Pat. No. 3,387,843, issued June 11, 1968; U.S. Pat. No. 4,183,520, issued Jan. 15, 1980; U.S. Pat. No. 4,227,689, issued Oct. 14, 1980; U.S. Pat. No. 4,254,949, issued Mar. 10, 1981; U.S. Pat. No. 4,441,708, issued Apr. 10, 1984; U.S. Pat. No. 4,448,412, issued May 15, 1984; and U.S. Pat. No. Des. 263,978, issued Apr. 20, 1982.

All of the foregoing exercise equipment have devices for exercising the thigh area of the leg. Much of this equipment has attachments, such as rowing bars, which may be added to exercise the upper body. Some of this equipment utilizes hydraulics in order to provide suitable resistance for the motion imparted while exercising.

However, none of the devices disclosed in the prior art patents discussed above are truly portable. Today, the typical amateur runner works in an office and cannot conveniently exercise during his or her working day. Many exercise enthusiasts live in apartments, college dormitories or with roommates where space is at a premium. For these people the exercise machines offered today are unsuitable as there is no place to store them when not in use.

SUMMARY OF INVENTION

Accordingly, it is an object of the present invention to provide a portable, exercise machine.

A further object of the present invention is to provide a portable, light weight exercise machine which may be utilized to exercise the lower body by extension or leg curls and to exercise the upper body by arm curls or rowing.

Yet a further object of the present invention is to provide a portable, light weight leg exercise machine which may be easily carried from place to place, easily assembled for use, and easily stored.

In accomplishing these and other objects, there is provided a portable housing which contains the parts for the exercise machine and which forms a platform upon which the exerciser sits. The weight of the exerciser retains the housing platform in the desired position while the exerciser places his ankles into suitable devices attached to a lever mechanism pivoted about a pivot point mounted upon the housing. A resistance device, such as a hydraulic or pneumatic plunger, is mounting from the housing to the lever mechanism for resisting motion imparted by the user. The user may replace or reposition the lever used to exercise his or her legs to exercise the upper arms, back and chest muscles.

In another embodiment, an exercise machine suitable for individually exercising the user's right or left leg muscles is also shown incorporating the principles of the present invention.

DRAWING

Other objects and advantages of the present invention will become apparent to those skilled in the art after consideration of the following specification and drawings, wherein.

Figure 4:
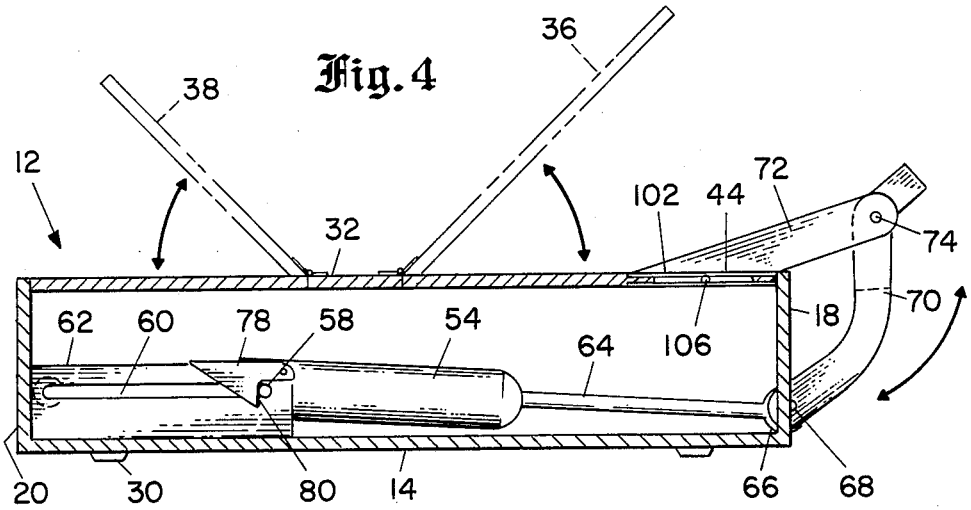
FIG. 4 is a cross-sectional view taken along line 4—4 of FIG. 3.
Figures 8, 9, 10, 11, 12, 14:
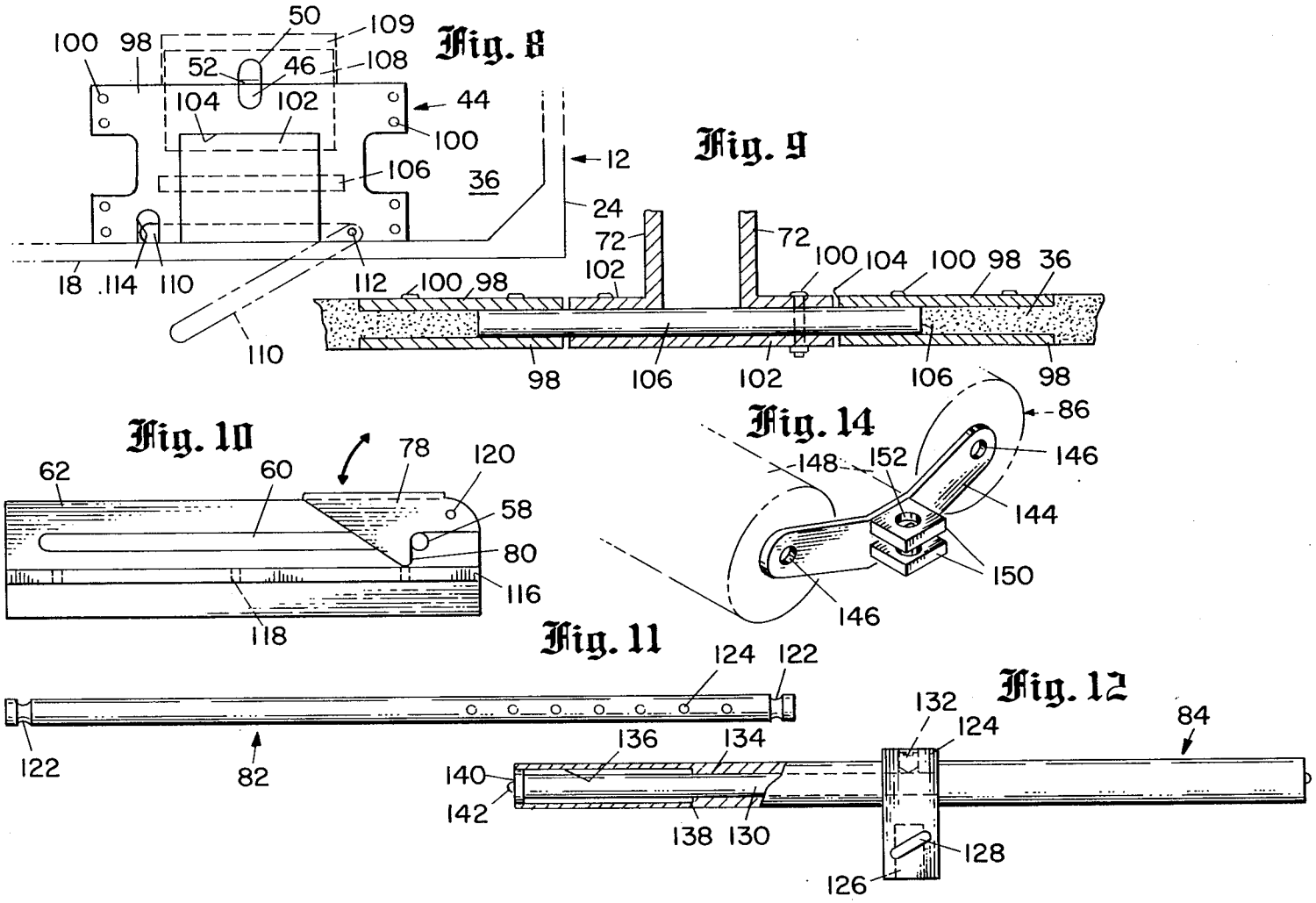
FIG. 8 is a top plan view similar to FIG. 7 illustrating the pivot head in greater detail.
FIG. 9 is a detailed cross-section of the pivot head within the case cover.
FIG. 10 shows a slide used within the case.
Figures 13, 15, 16:
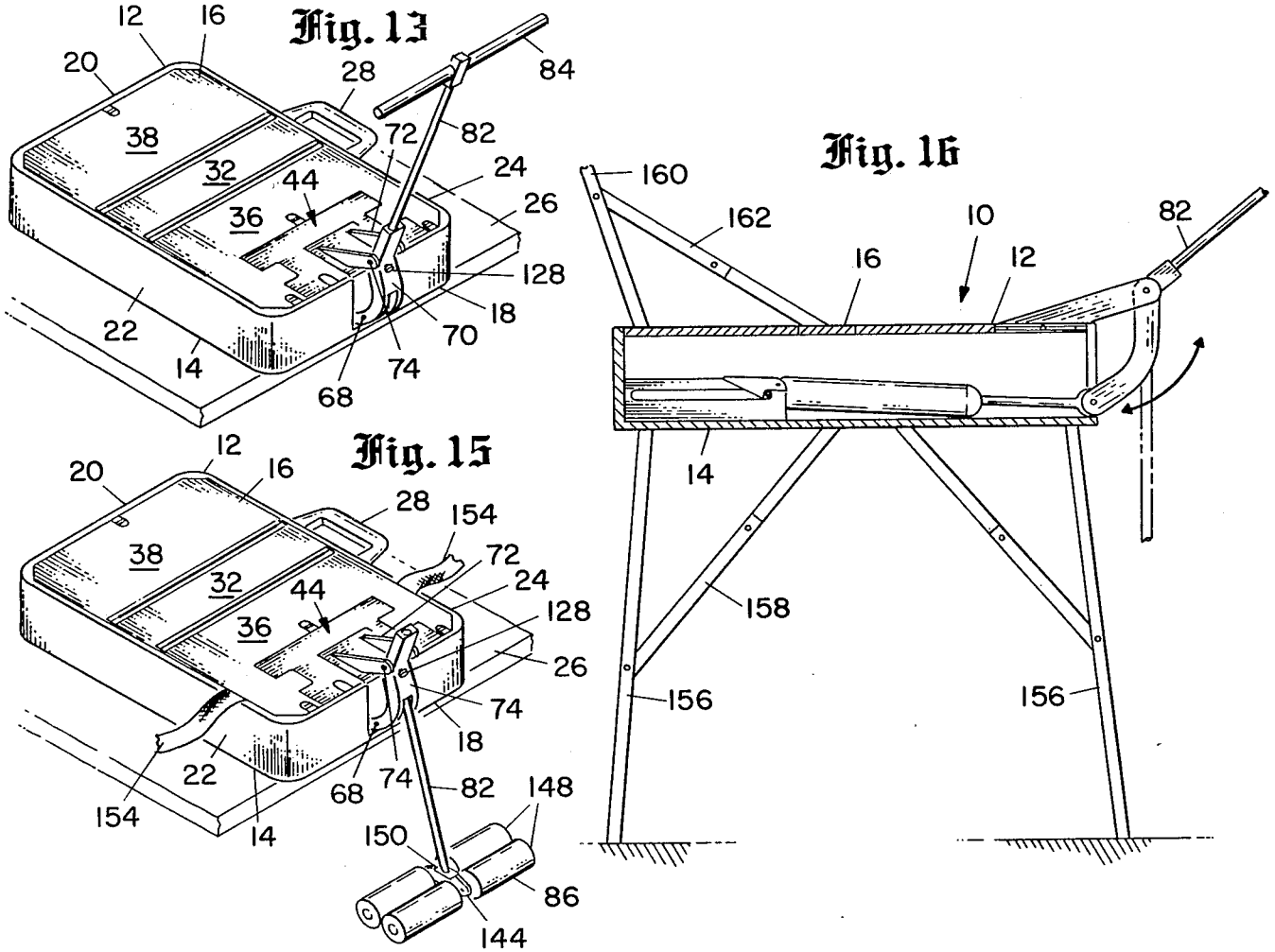
Figure 17:
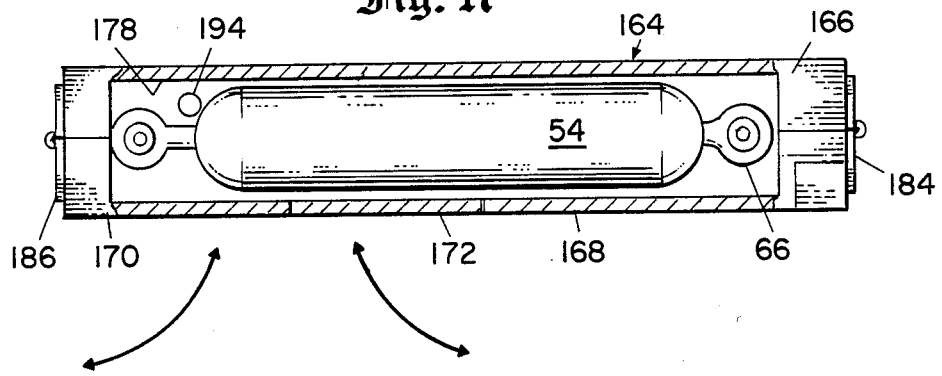
Figure 18:
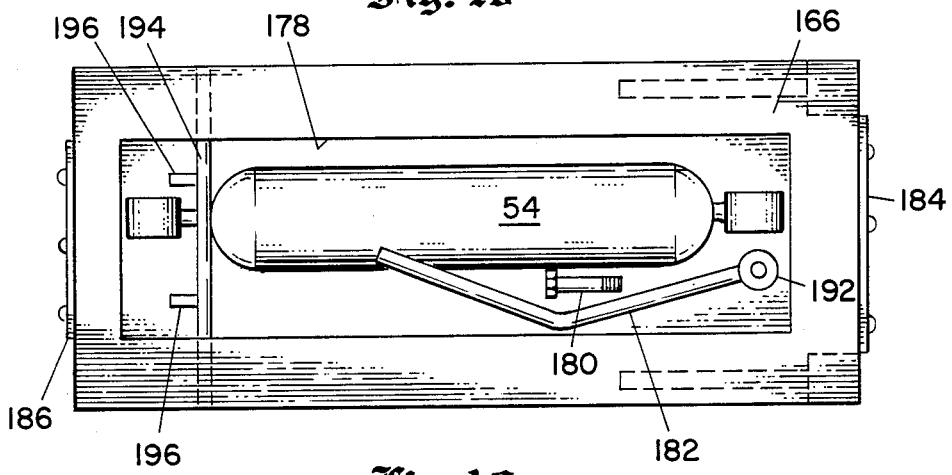
Figure 19:
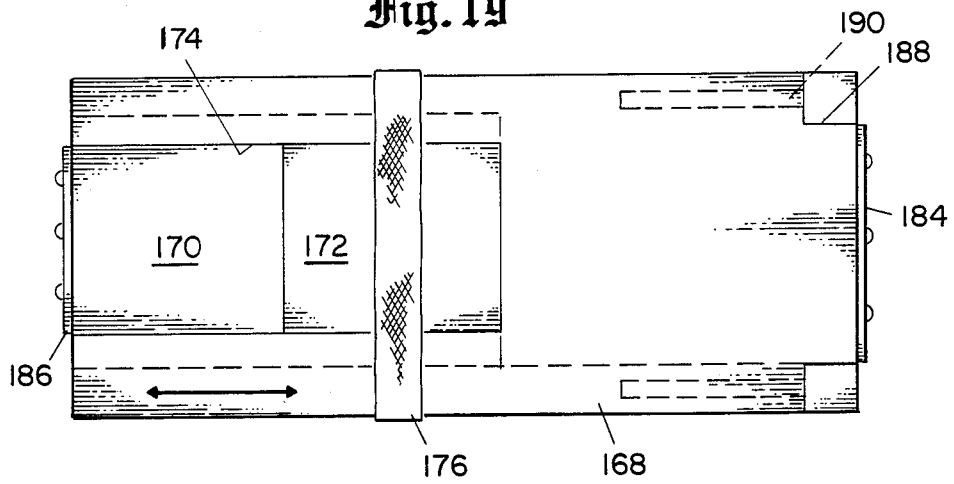
Figures 20, 21:
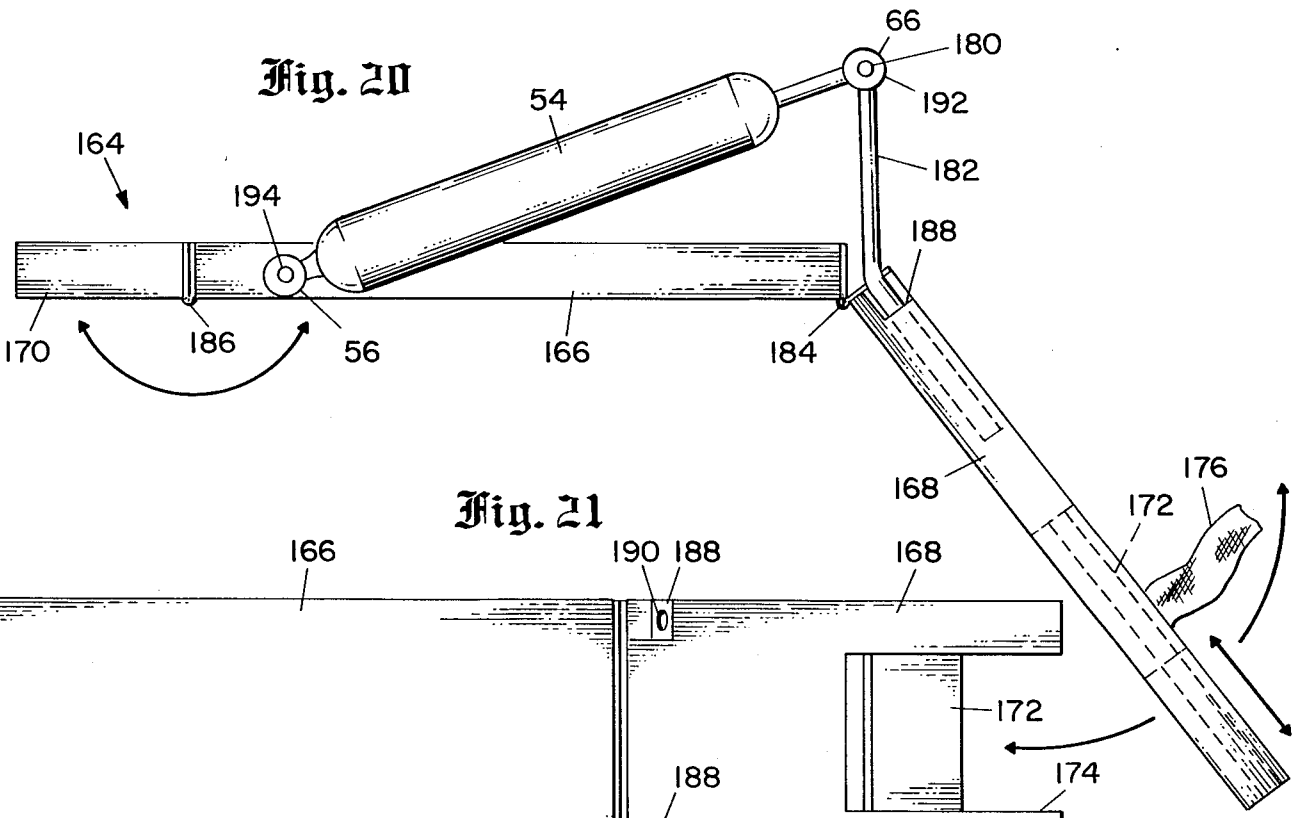

FIG. 11 details a lever rod stored within the case and used with the exercise machine;

FIG. 12 is a handle also stored within the case and used with the machine;

FIG. 13 is a prospective view illustrating the exercise machine with the lever rod and handle assembled for a rowing exercise;

FIG. 14 illustrates a bracket that forms an ankle stirrup stored within the case;

FIG. 15 is a prospective view showing the exercise machine with the lever rod and stirrup assembled for leg exercise;

FIG. 16 is a cross-sectional view, similar to FIG. 4, showing modifications of the present invention;

FIG. 17 is an end view of an exercise machine, incorporating the present invention, for exercising a single right or left leg;

FIG. 18 is a top plan view of the machine shown in FIG. 17;

FIG. 19 is a bottom view showing the exercise machine of FIG. 17;

FIG. 20 is a side view illustrating the exercise machine of FIG. 17 assembled for use with the right leg; and FIG. 21 is a top plan view of the machine shown in FIG. 20.

DESCRIPTION OF THE PREFERRED EMBODIMENTS

Figure 1:
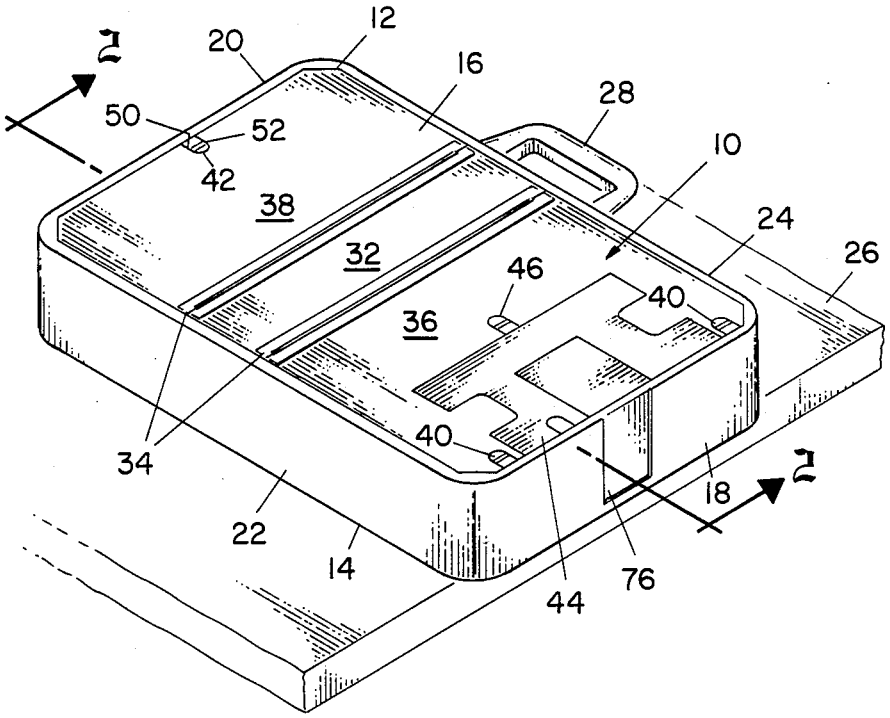
FIG. 1 is a prospective view showing the exercise machine of the present invention within its housing which forms a portable case.

Referring now to the drawings, FIG. 1 shows a portable, light weight exercise machine 10 contained within a housing 12 having a bottom surface 14, top surface 16, front-edge surface 18 and back-edge surface 20. The remaining edge surfaces include a bottom or left surface 22 and a top or right surface 24, when viewed from FIG. 1. A combination of the six surfaces 14–24 forms the housing 12 which, when placed upon a table, desk or other suitable surface 26 forms a platform upon which a user may sit when exercising with the portable exercise machine 10. Housing 12 is intended to resemble a briefcase in size, shape and weight. In order to promote portability, a handle 28 is attached to the top or right-hand surface 24. The lower surface 14 of housing 12 may also be provided with resilient bumpers 30, FIG. 2, to protect the table 26 and prevent the motion of the housing 12 when a user is sitting and exercising thereon. The bumpers 30 may be secured by screws, not shown. Similar bumpers may also be placed upon the bottom or left-hand surface 22, if desired.

The top surface or platform 16 includes a central hinge plate 32 to which is mounted, as by screws, a pair of piano hinges 34. Hinges 34 secure a front facing lid 36 and a back facing lid 38. The lid 36 may be latched by a pair of slideable latches 40, while lid 38 is latched by a single latch 42. Mounted within the lid 36 is a pivot head assembly 44 which is latched in either a portable or useable position by a third sliding latch 46.

As seen in FIG. 9, the housing lids 36 and 38 may be formed from laminated material. This laminated material may comprise three layers although it will be understood that other arrangements may be utilized. Each latch 40, 42 or 46 slides within the central laminated layer and is retained by the lowermost and uppermost laminate. The uppermost laminate, as shown in FIGS. 1 and 8, is provided with a slot 50 through which an upward extending shoulder 52 protrudes from the latch plate 42 to permit the user to grasp both sides of the shoulder 52 to move the latch 40, 42 or 46 into the position desired along the slot 50.

Figure 2:
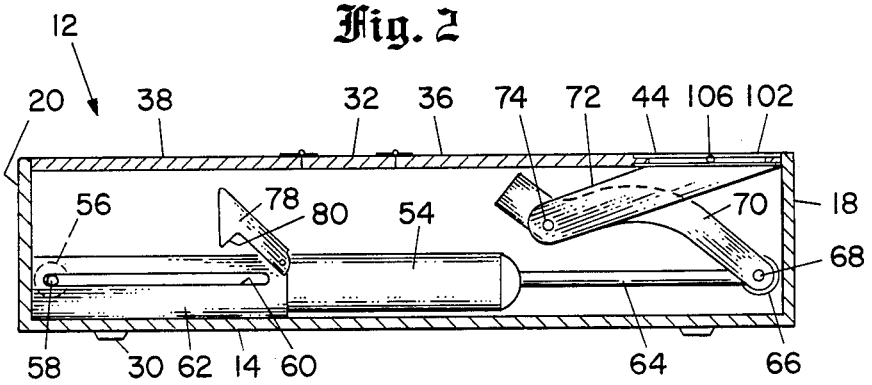
FIG. 2 is a cross-sectional view of the exercise machine taken along line 2—2 of FIG. 1.
Figure 6:
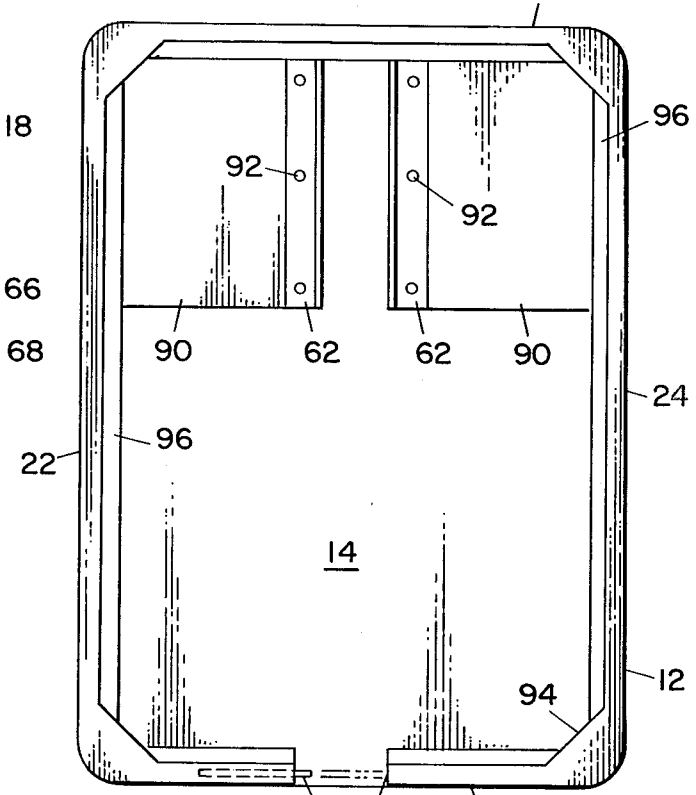
FIG. 6 is a top plan view showing the lower portion of the housing in greater detail.
Figure 5:
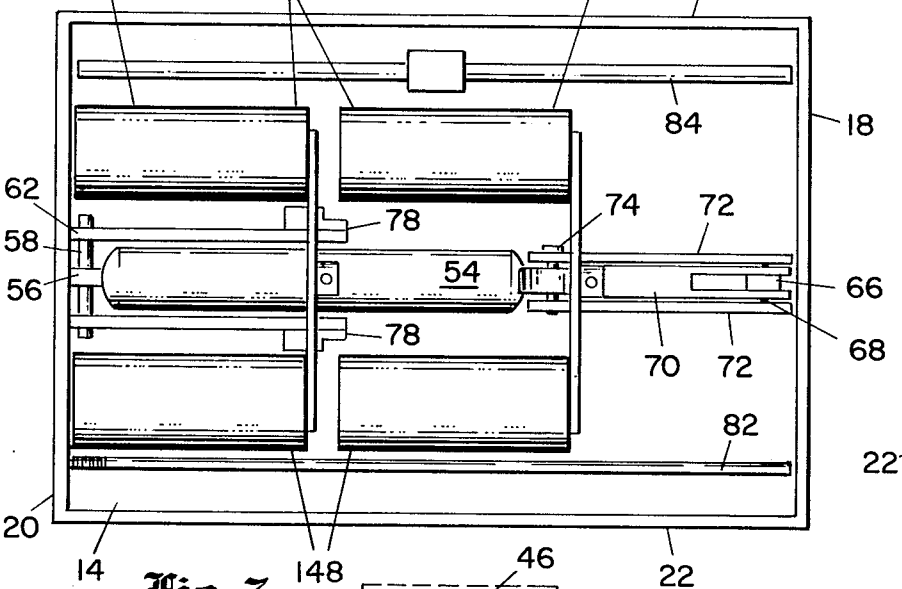
FIG. 5 is a top plan view showing the exercise machine of the present invention and the various parts thereof within the portable case.

In FIG. 2, a cross-sectional view discloses one embodiment for mounting some of the component parts of the portable exercise machine 10 within housing 12. One major component is a resistance device, such as a hydraulic or phneumatic plunger 54. As seen in FIGS. 2, 4 and 5, the resistence device 54 includes an eyelet 56 through which a pin 58 is inserted. Pin 58 is long enough to pass through slots 60 in slides 62 parallelly mounted on either side of the resistence device 54. As best seen in FIGS. 6 and 10, slides 62 may be formed by a T-shaped extrusion wherein the top of the T is arranged vertically with one side thereof longer than the other, FIG. 10. The slot 60 is placed within the longer side. The resistence device 54 is thus retained within housing 12 by the interaction of the eyelet 56 and pin 58 within slots 60 of slides 62. From the opposite end of the resistence device 54 extends a movable plunger 64 having a second eyelet 66 attached at the far end. A pin 68 is passed through eyelet 66 for connecting the plunger 64 to an armature 70. Armature 70 is S-shaped and bifurcated at the end which passes around eyelet 66 to form a pair of legs, FIG. 5, through which pin 68 may pass for making a pivotal connection between plunger 64 and armature 70. Armature 70 is also pivotally mounted to a pair of parallel legs 72 by a pin 74.

Figure 3:
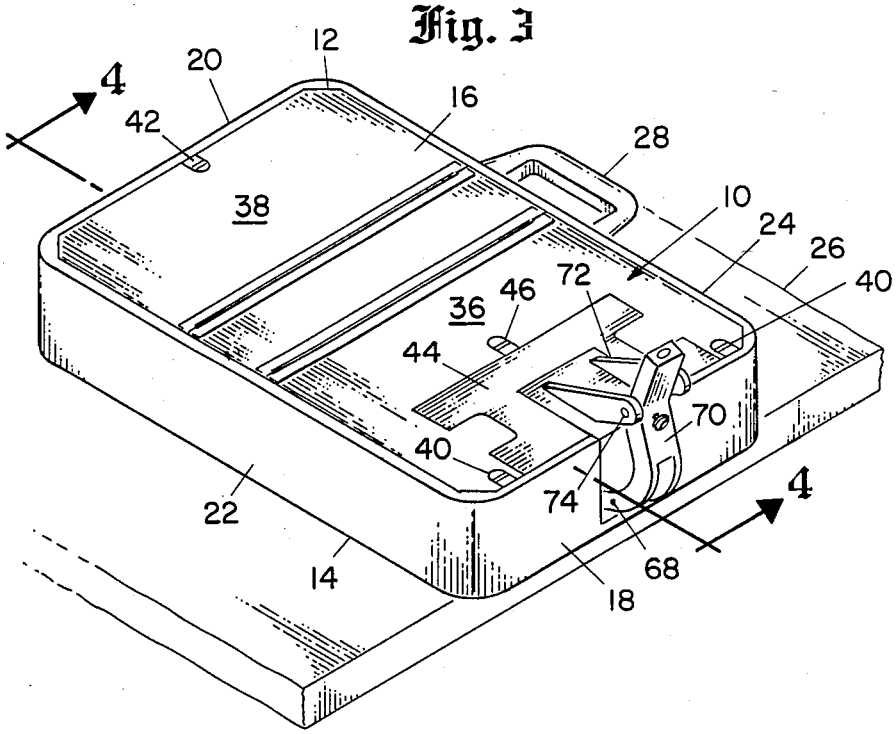
FIG. 3 is a prospective view of the exercise machine with a pivot head thereof rotated 180 degrees.

When one wishes to use the portable exercise machine 10 of the present invention, he or she places the machine upon the table 26, shown broken away FIGS. 1 and 3, and slides a door 76, shown in FIGS. 1 and 6, to the left. This creates an opening 77 through which the pivot head assembly 44 may be rotated 180 degrees. As seen in FIG. 4, the lifting of front facing lid 36 causes the legs 72 to lift the armature 70 to expand the pivotal cooperation there between. Once the lid is lifted a suitable distance, the pivot head assembly 44 may be freed to permit its rotation 180 degrees. In doing so, the resistance device 54 is slid along slot 60 to its far-right side, FIG. 4, to permit a pair of latches 78 to be urged in an upward direction by the engagement of pin 58 and there retained as the pin 58 passes beyond latching shoulders 80. Once the pivot head assembly 44 has rotated through 180 degrees, the latch 46 which was moved in an upward direction to free the head 44 may be pushed down to latch the assembly. The details of the latch assembly are shown in FIGS. 8 and 9 and described hereinbelow.

After the pivot head assembly 44 is positioned, as shown in FIGS. 3 and 4, it is possible to assemble the rest of the exercise machine 10. The remaining component parts of the machine 10 stored within the housing 12 and removed when the head assembly 44 was rotated 180 degrees, include: a lever rod 82, shown in greater detail in FIG. 11; a handle 84, showin in greater detail in FIG. 12; and a pair of stirrups 86 which may consist of one or two ankle brackets which will be described in greater detail hereinbelow with regard to FIG. 14. The components described briefly hereinabove all fit within housing 12 as shown in FIG. 5. When the pivot head assembly 44 is in the position shown in FIG. 2, the housing 12 may be carried from place to place like a briefcase.

In the preferred embodiment, it is envisioned that the size of the housing 12 may be 20½ inches long by 14 inches wide by 4½ inches high and weigh approximately 20 pounds. A one leg unit to be described hereinbelow, FIGS. 17–21, may have an overall housing size of 17 inches long by 7 inches wide by 2¾ inches high. The housing shown in the figures herein are generally square in configuration and may be formed from wood, sheet metal or other suitable materials. However, it will be understood that the structure of the housing 12, for example, including bottom surface 14 and the four sides 18–24 may be formed by a single, die caste piece. As such, the housing structure may be formed to better suit the human anatomy. That is, the top surface 16, including its hinge plate 32 and lids 36 and 38, may be formed with the contour of a saddle wherein a raised pommel-like surface would incorporate the pivot head assembly 44 with the back-edge surface also raised to form a cantle. In such a configuration, the stirrups 86 could be formed as a single unit rather than the split unit shown in FIG. 5, as there would be enough room in housing 12 to hold the single unit.

The machine 10, as shown in FIG. 3, is ready to be assembled for exercising either the lower or upper body depending upon which end of the armature 70 receives the lever rod 82. Before describing the exercise machine further, the details of its structure and parts will be described with reference to FIGS. 6–12 and 14.

As seen in FIG. 6, the housing 12 may consist of a four-sided box including sides 18–24. Side 18 is provided with an opening 77, which is closed by the slideable door 76, to accommodate the rotation of the pivot head assembly 44. The bottom surface 14 maybe been reinforced by plates 90 which extend across surface 14 to the slide angles 62. As stated above, each slide angle 62 is formed with a T-shape having the top of the T formed with a short and long leg. The short leg of the T extends over the vertical edge of the plate 90 to the top of surface 14. Slide angles 62 may be mounted to plates 90 and surface 14 by suitable fasteners, such as screws or rivets 92. If the housing 12 is to be molded, plates 90 may be built into the design of the die mold. Each edge wall 18–24 is reinforced by a chamfer 94. Just below the chamber each edge wall is provided with a lip 96 which receives, and provides a mounting surface for, the hindge plate 32 and front and back facing lids 36 and 38.

Figure 7:
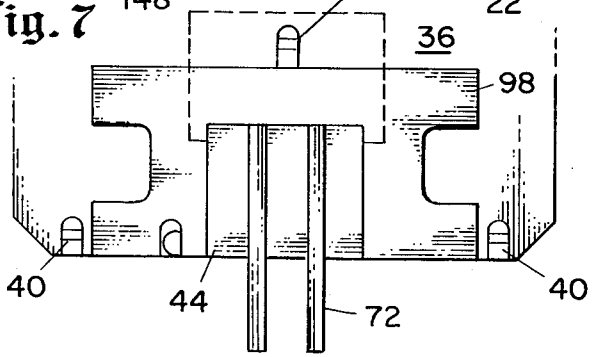
FIG. 7 is a partial top plan view showing the cover and pivot head of the exercise case.

Referring now to FIG. 7, 8 and 9, the details of the pivot head assembly 44 will be described. The assembly 44 is formed from a pair of retainer plates 98 which may be fastened on either side of the lid 36 by a plurality of suitable fastening devices, such as rivets or nuts and bolts 100. In the preferred embodiment, the fastening devices are flat head rivets which permanently mount the plates 98 to lid 36. Rotation of the pivot head assembly 44 is accomplished by a second pair of plates 102, FIG. 8, aligned with the plates 98 and rotatively mounted within a rectangular aperture 104 by a pin 106. The pin 106 is relatively large, equal in thickness to the space between plates 98. It will be understood that pin 106 must absorb the full force exerted by the user of the exercise machine 10.

Plates 102 are latched in their desired position by the latch 46 which includes a relatively large latch plate 108 that slides within a chamber 109 formed within lid 36. It will be seen in FIG. 8 that sliding the shoulder 52 of latch 46 in an upward position will remove the plate 108 from between the plates 102. This will permit the plates to rotate 180 degrees about pin 106. Once rotated 180 degrees, the shoulder 52 may be slid in a downward direction for re-engaging plate 108 between plates 102. To reinforce the latching action, a bar 110 may be mounted by a pin 112 between plates 98. A finger hole 114 is provided in at least one of the plates 98 for access to the bar 110. By pivoting the bar into the position shown in FIG. 8, it is possible to unlatch the two plates 102 to permit their rotation. Access to the bar 110 is had by lifting the lid 36, as shown in FIG. 4. Once the plates 102 are rotated into in the proper position, the bar 110 may be returned to its position before lowering lid 36 into housing 12.

As seen in FIG. 9, one of the two plates 102 may be formed to include the legs 72 which mount the armature 70. That is, each leg 72 may be formed with a right angle bend to form one plate 102 which is attached by fasteners 100 to the second plates 102 to permit the mounting of pin 106 there between. This configuration is also illustrated in FIGS. 2 and 4.

In FIG. 10, the slide 62 is shown in greater detail illustrating the T-shaped configuration with the center leg of the T shown at 116 having suitable aperture 118 therein for receiving the fasteners 92 shown in FIG. 6. It will now be seen that the latch 78 may be mounted to slide angle 62 by a pin 120. As pin 58 traverses the slot 60 it strikes the taperred surface of latch 78 for raising that surface to permit the shoulder 80 to engage and retain the pin 58 in the position shown.

In FIG. 11, the lever rod 82 is shown with each end having a groove 122 which may receive the armature 70 or handle 84. Rod 82 is also provided with a plurality of apertures 124 which adjustably mount the stirrups 86.

In FIG. 12, the handle 84 is shown including a centrally located handle pivot 124 having an aperture 126 in its lower surface for receiving the rod 82. A thumbscrew 128 is mounted into pivot 124 and provided with a chafered end for engaging the groove 122 in lever 82. Thumbscrew 128 may be provided with a nylon insert in its threads to provide a locking configuration with mating threads in pivot 124. This allows the partial tightening of the thumbscrew into groove 122 which permits the rotation of handle 84 upon the end of lever 82. Such rotation assures the user that equal force will be applied to each slide of the handle 84 thus exercising muscle sets of each arm, for example, in an equal manner.

Handle 84 further includes a single rod 130 which passes through the pivot 124 and is retained in a centered position therein by a fastener, such as a set screw 132. Surrounding the rod 130 on either end are a pair of tubes 134 which have been counterbored at 136. The counterbores permit the tubes 134 to be extended in an outward direction until shoulders 138 formed at the bottom of the counterbores 136 engage a pair of washers 140 retained on the ends of rod 130 by suitable fastening means such as screws 142.

Referring now to FIG. 13, and comparing this figure with FIG. 3, it will be seen that the rod 82 may be inserted into an aperture in the upper portion of armature 70. A second thumbscrew 128 may then be tightened into groove 122 to retain the rod in armature 70. By turning the thumbscrew 128 on handle 84, the handle 84 is attached to the upper end of rod 82. A user may now sit upon the platform formed by the top surface 16 of housing 12 with his or her legs on either side of the pivot head assembly 44. In the preferred embodiment, the exercise machine 10 has been placed upon the edge of a table or desk 26 so that the user's legs may extend down over the edge of the desk. The user may now conduct arm curls or rowing exercises. The user may also rock back and forward from the torso to exercise lower back and abdomen muscles. If the user chooses, a pair of straps may be attached across the upper portion of his or her legs and secured by suitable fasteners, such as nylon hooks mounted to one strap which engage nylon loops mounted on the other strap. Such a fastener is sold under the trade name Velcro. This arrangement is shown in FIG. 15.

Referring now to FIGS. 5 and 14, the details of the stirrups 86 will be seen. The stirrup 86 is formed by a metal bracket 144, FIG. 14, which has a generally V-shaped configuration. Apertures 146 in the upper legs of the V-shape mount a pair of cylindrically shaped rods 148 which may be padded with sponge rubber or foam and covered with leather or vinyl as desired. Extending from the lower or mid-portion of the V-shaped bracket 144 are a pair of equally spaced blocks 150 each having an aperture 152 therein which is aligned in parallel to receive the rod 82.

As seen in FIG. 15, the stirrups 86 formed by brackets 144 are mounted upon rod 82 by inserting interleaved 150 from each of the brackets 144 so that the four blocks are aligned with their apertures 152 forming a passageway through which the lever 82 may be passed. The location of the stirrups 86 is then adjusted by inserting a hairpin clip, not shown, into the apertures 124 in rod 82. The user may then sit upon the upper surface 16 of housing 12 and insert his or her ankles between the padded rods 148. Suitable straps 154 may be tightened across the upper portion of the user's legs for stability. The user may then move the rod 82 up and down by use of his or her thigh muscles against the resistance of the resistive device 54. The user's weight will retain the housing 12 upon table 26 throughout the exercise series.

The portable exercise machine 10 may be equipped with legs 156, FIG. 16, which fold from the bottom surface 14 of housing 12 and are latched in an open position by latching arms 158. Similarly, a back rest 160 may be folded from the top surface 16 of housing 12 and retained in its directed position by latch arms 162. This arrangement retains the portability of the unit while eliminating the need for a desk or table 26.

The embodiments discussed thus far describe an exercise machine 10 which exercises both legs or both arms of the user. However, the present invention may also be utilized within a smaller, portable exercise machine to exercise but one leg at a time. This type of machine may be used by individuals who have a need to exercise but one leg to strengthen a muscle set that may have been injured from a broken bone, sprained joint or torn legiment.

The single leg machine is shown in FIGS. 17–21. The machine consists of four housing parts hinged together to enclose the components of the machine into a portable case or housing 164. The four components include an upper lid 166, lower lid 168, rear flap 170, and slide 172. As seen in the assembled views, FIGS. 17–19, the rear flap 170 fits into a slot 174 in the lower lid 168 when the slide 172 is moved to the very bottom of this slot, FIG. 19. A Velcro strap 176 attached to the slide 172 wraps around the lower lid 168 and upper lid 166 to secure the exercise mechanism, FIG. 19.

The upper and lower lids, 166 and 168, as well as the rear flap are relieved to provide a compartment 178 which receives the resistance device 54, a bolt 180, and an armature 182, shown in FIGS. 17 and 18. When assembling the portable exercise machine 164 for use, the strap 176 is removed and lower lid 168 opened from upper lid 166 about a hinge 184 shown on the right in FIGS. 17–19. Similarly, the rear flap 170 is opened from the upper lid 166 about a second hinge 186.

It will be seen in FIGS. 20 and 21 that the lower lid 168 includes a notch or relieved portion 188 on each side of the lid closest to hinge 184. In the bottom of the notch 188 is an aperture 190 which receives the armature 182. Note that armature 182 is bent 45 degrees at its mid-section. The upper portion of the armature 182 is provided with an eyelet 192 which is threaded to permit the bolt 180 to pass through the eyelet 66 of the resistance device 54 for attaching that device. A second eyelet 56 at the opposite end of the resistance device 54 receives a pin 194 mounted in the upper lid 166. Pin 194 has 2 extending rod stops 196, FIG. 18, which permit the pin 194 to be slid to the left or right of the upper lid 166.

By sliding pin 194 to the lower portion of the upper lid 166, FIG. 18, it will be seen that the stop 196 prevents the pin 194 from extending beyond that point where the stop 196 engages the compartment 178. Eyelet 56 from the resistance means 54, is then engaged with pin 194. As seen in FIGS. 20 and 21, the exercise machine contained within housing 164 has been set up to exercise the user's right leg. After attaching eyelet 66 from resistance device 54 to the armature 182 using bolt 180, the user may place his or her ankle over the slide 172. In FIG. 20, it will be seen that the slide 172 slides within the opening 174 left by the rear flap 170 within slots in lower lid 168. By aligning the slide with the user's ankle and wrapping the Velcro strap around that ankle, the user may raise and lower his or her leg at the hip about the joint formed by hinge 184. As this motion occurs, the slide 172 absorbs any change in length due to the motion of the user's leg while sitting upon the platform formed by upper lid 166.

If the user wished to exercise the left leg, he or she disassembles the device contained within housing 164, moves the pin 194 to the opposite side of its aperture and reassemble thes device by placing the armature 182 within the aperture 190 on the opposite side of the lower lid 168.

While the present invention has been described as a portable exercise machine for the upper and lower body, it will be seen that the device may be used for a single leg or both legs as well as the upper body. Further, the device may be fabricated from individual pieces or molded from complex die molds. The use of Velcro straps may or may not be employed, and legs or back rests may also be incorporated into the portable device. Accordingly, the present invention should be limited only by the apparent claims.

I claim:

1. A portable exercise machine for working opposing muscle sets of a user's muscular system, comprising:

platform means upon which said user sits to secure said portable exercise machine for use;

pivot means mounted upon said platform means;

lever means connected to said pivot means including means for engagement by said user;

resistance plunger means slidably mounted upon said platform means and connected to said pivot means to be slid into an operative position as said pivot means is rotated in said platform means;

said platform means comprises a walled container to whose walls said resistance plunger means and pivot means are permanently mounted and into which said plunger, pivot, and lever means are stored; and said resistance plunger means resisting, in first and second directions, the motion of said lever means imparted by said user wherein said user works one muscle set in said first direction and works an opposing muscle set in said second direction.

2. An exercise machine, as claimed in claim 1, wherein said platform means supports both buttocks of said user.

3. A portable exercise machine, as claimed in claim 1, wherein said means for engagement are stirrup means, said lever means extend below said platform means, and said opposing muscle sets include the quadriceps and leg biceps of said user's legs.

4. A portable exercise machine, as claimed in claim 1, wherein said means for engagement are handled means, said lever means extend above said platform means, and said opposing muscle sets include the chest and back muscles of said user's torso.

5. A portable exercise machine, as claimed in claim 1, wherein said platform means further includes foldable leg means mounted upon the lower surface of said platform means.

6. A portable exercise machine as claimed in claim 1, wherein said platform means further includes back rest means foldably mounted upon the upper surface of said platform means.

7. A portable exercise machine as claimed in claim 1, additionally comprising:

strap means;

said strap means mounted to said platform means to wrap about said user while sitting upon said platform; and means for closing said strap means.

8. A portable exercise machine as claimed in claim 1, additional comprising:

said platform having a lid;

said pivot means mounted within said lid;

said resistance plunger means permanently attached to said platform and permanently attached to said pivot means wherein the opening and closing of said lid permits said pivot means to assume an operating and a storage position which slides said resistance plunger means into an operating and storage position.

9. A portable exercise machine as claimed in claim 8, wherein said pivot means includes: a pivot head assembly mounted within said lid for rotating said pivot means 180 degrees, a pair of parallel legs extending from said pivot head assembly, and an armature having two ends, one end mounted between said legs and said second end permanently attached to said resistance plunger means.

10. A portable exercise machine for working the muscular system of a user, comprising:

housing means;

pivot means mounted upon said housing means for rotation from a first stored position into a second operating position;

lever means detachably mounted to said pivot means when in said second operation position;

means for engagement extending from said lever means for engagement by said user; and resistance means permanently connected to and slidably mounted within said housing means and permanently connected to said pivot means wherein movement of said pivot means from said first stored position to said second operating position slides said resistance means into said operating position.

11. A portable exercise machine as claimed in claim 10, wherein said housing means is formed to create a platform for both buttocks of said user and said housing means is retained in an operation position by the weight of said user upon said housing.

12. A portable exercise machine as claimed in claim 10, wherein said lever means extends below said housing means and said means for engagement are stirrup means to exercise said user's lower body.

13. A portable exercise machine as claimed in claim 10, wherein said lever means extend above said housing means and said means for engagement are handle means to exercise said user's upper body.

14. A portable exercise machine for working the muscular system of a user, comprising:

housing means;

pivot means mounted upon said housing means for rotation from a first stored position into a second operation position;

lever means mounted upon said housing by said pivot means;

means for engagement extending from said lever means for engagement by said user;

resistance means permanently and slidably mounted within said housing means and permanently connected to said pivot means wherein movement of said pivot means from said first stored position to said second operating position slides said resistance means into said operating position;

means for latching said resistance means in said operating position wherein movement of said lever means by said user will be resisted by said resistance means;

said housing means secured in its working position by the weight of said user while sitting thereon during use; and said housing means having means to receive said pivot means and lever means when not in use, whereby said exercise machine may be made portable.

15. A portable exercise machine as claimed in claim 14, wherein said lever means extends below said housing means and said means for engagement are stirrup means to exercise said user's legs.

16. A portable exercise machine as claimed in claim 14, wherein said lever means extend above said housing means and said means for engagement are handle means to exercise said user's upper body.

17. A portable exercise machine as claimed in claim 14, additionally comprising:

said housing means having lid means;

said pivot means mounted within said lid means and rotated 180 degrees from said first storage position to said second operation position.

* * * * *